United States Patent [19]

Radsavitch

[11] 4,185,351

[45] Jan. 29, 1980

[54] CHIMNEY CLEANING APPARATUS

[76] Inventor: Joseph L. Radsavitch, 262 State St., Larksville, Pa. 18704

[21] Appl. No.: 939,883

[22] Filed: Sep. 5, 1978

[51] Int. Cl.[2] ..... F23J 3/00

[52] U.S. Cl. ..... 15/243

[58] Field of Search ..... 15/162, 163, 242, 243, 15/246.5, 249; 166/162; 254/142

[56] References Cited

U.S. PATENT DOCUMENTS

| | | | |
|---|---|---|---|
| 102,274 | 4/1870 | Kendall | 254/142 |
| 775,157 | 11/1904 | Watt | 254/142 |
| 1,475,229 | 11/1923 | Heimerman | 15/249 |
| 4,028,769 | 6/1977 | Coviello et al. | 15/249 |

FOREIGN PATENT DOCUMENTS

| | | | |
|---|---|---|---|
| 132946 | 9/1951 | Sweden | 15/163 |

*Primary Examiner*—Philip R. Coe
*Attorney, Agent, or Firm*—Donald A. Kettlestrings

[57] ABSTRACT

Apparatus for cleaning flue-lined chimneys wherein the apparatus includes a pulley supporting structure removably secured on the upper edge of the flue. A chain or rope extends upwardly from ground level through the pulley and is attached to a chimney cleaning device positioned within the chimney. A catch assembly is attached to the pulley supporting structure for enabling an operator at ground level to selectively place the cleaning device in a fixed storage position within the chimney when the device is not in use and to release the cleaning device for movement within the chimney when it is desired to clean the flue. The cleaning device is easily and quickly placed in the fixed storage position and released therefrom by simple movements of the rope from ground level.

7 Claims, 5 Drawing Figures

Fig. 1.
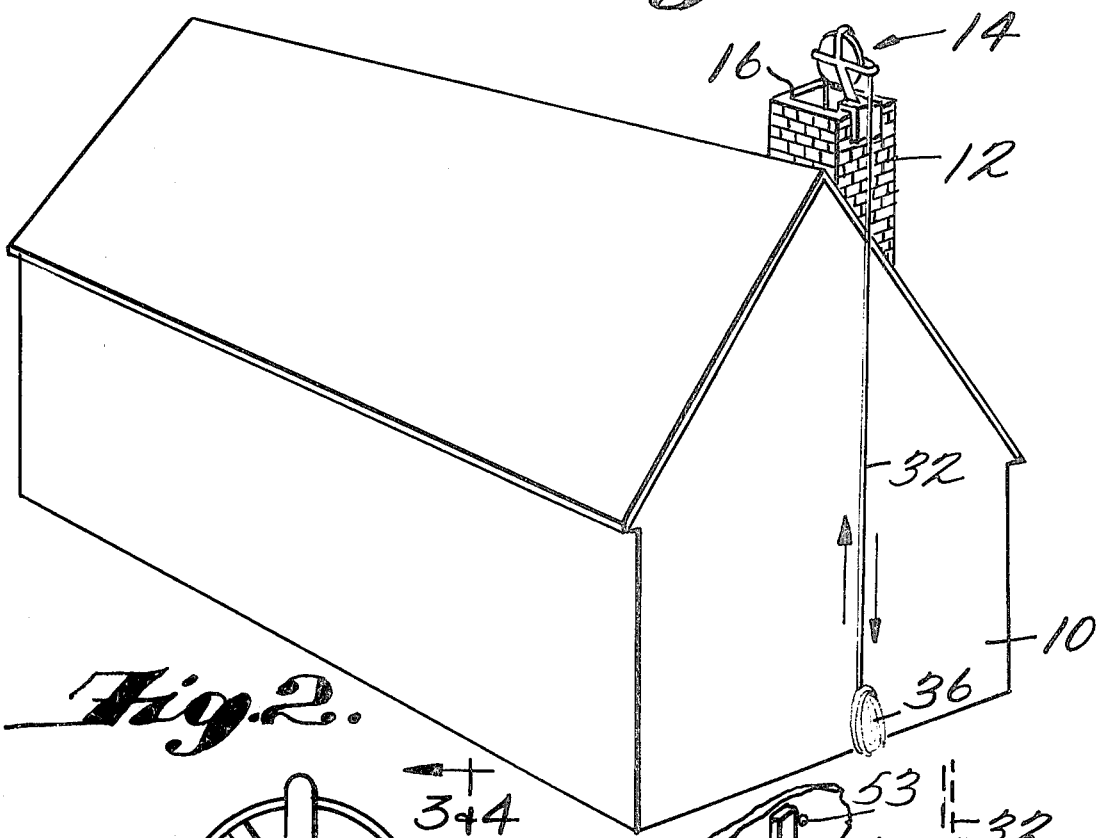
Fig. 2.
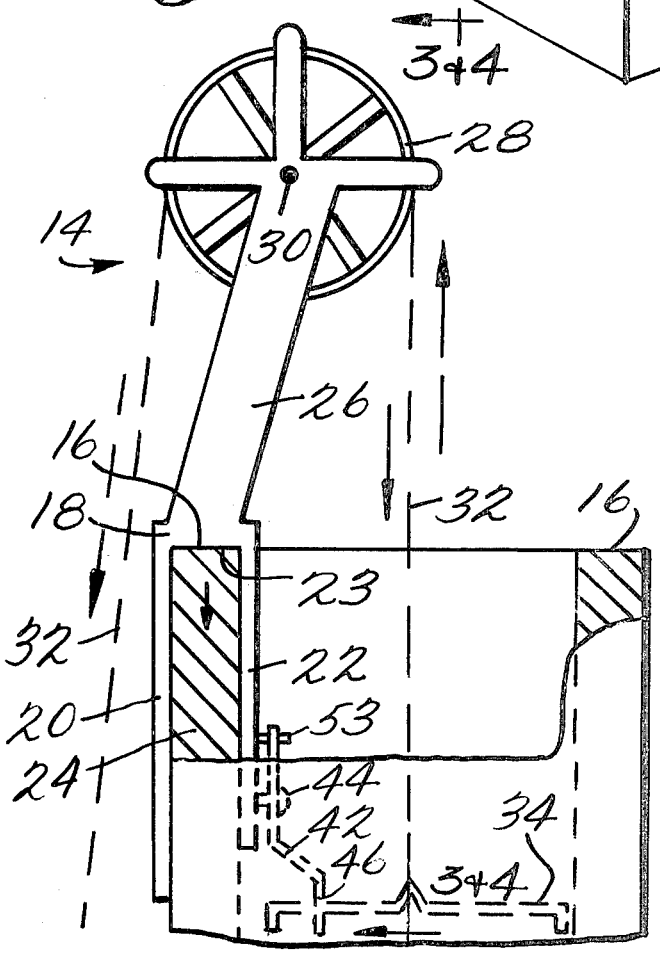
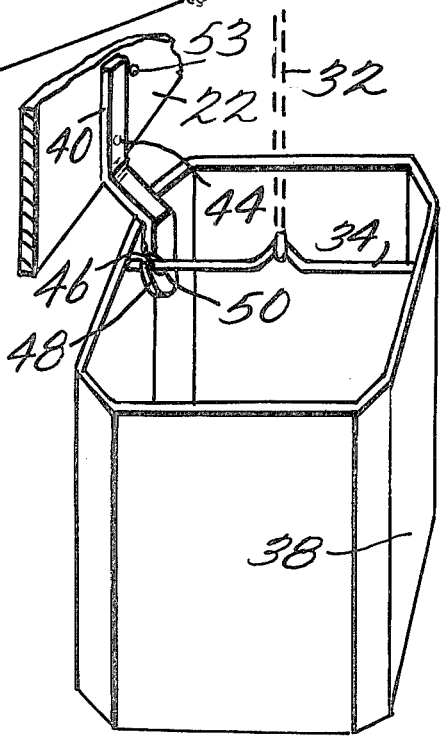
Fig. 5.

CHIMNEY CLEANING APPARATUS

This invention relates to apparatus for cleaning chimney flues, and more particularly to such apparatus having a catch assembly for enabling an operator standing at ground level to easily lock a cleaning device into fixed position within the flue and to quickly and safely remove the cleaning device from its locked position for movement within the flue.

There are known chimney cleaning devices which provide for the cleaning of chimney flues with the operator located at ground level, but a common problem with such known devices is that it is difficult to easily and safely lock the chimney cleaning element into a fixed position when the element is not in use and to quickly and safely release the cleaning element when it is desired to clean the flue. Some known devices require careful and tedious manipulation of the line attached to the cleaning element in order to position the cleaning element into fixed position when not in use and to unlock the cleaning element for introduction into and movement within the chimney flue.

Still other such known devices provide lines attached to the cleaning element with the lower end of the line attached to a keeper secured to the building at ground level. This arrangement can be unsafe because children, by merely removing the line from the keeper, will cause the cleaning element to rapidly fall to the bottom of the chimney.

It is, therefore, an object of the present invention to provide chimney cleaning apparatus operable from ground level.

Another object is to provide chimney cleaning apparatus which is easily and safely operated.

A further object of the invention is the provision of apparatus for cleaning chimney flues wherein the cleaning element can be quickly and easily locked into position and released from its locked position by an operator standing at ground level.

Still another object is to provide chimney cleaning apparatus which is operated externally of the chimney and from ground level.

Yet another object of the present invention is the provision of the chimney cleaning apparatus which easily and safely locks the cleaning element into position within the chimney when not in use.

Additional objects and advantages of the invention will be set forth in part in the description which follows, and in part will be obvious from the invention, or may be learned by practice of the invention. The objects and advantages are realized and attained by means of the instrumentalities and combinations particularly pointed out in the appended claims.

To achieve these and other objects the present invention provides means for movement within the chimney for cleaning the interior of the chimney, means in operative relationship with the cleaning means for movably supporting the cleaning means inside the chimney, and means in operative relationship with the supporting means for holding the cleaning means in a fixed position when the apparatus is not in use.

Preferably, an arm member is movably attached to the supporting means and the arm member defines a hook at one end thereof for receiving and holding a portion of the cleaning means when the cleaning means is in the fixed position. It is also preferred that the holding arm be rotatably attached to the supporting means about an axis positioned to cause the hook end of the holding arm to normally be positioned below the other portions of the holding arm when the arm is in a normal, at-rest position.

In accordance with the invention, the hook preferably defines an end camming surface and a slot having an inner camming surface. The end camming surface is normally positioned to slideably contact a portion of the cleaning means when the cleaning means is moved upwardly and into contact with the holding arm, and the inner camming surface is normally positioned to slideably contact a portion of the cleaning means when the cleaning means is moved upwardly from the fixed position.

It is to be understood that both the foregoing general description and the following detailed description are exemplary and explanatory, but are not restrictive of the invention.

The accompanying drawings, which are incorporated in and constitute a part of this specification, illustrate an example of a preferred embodiment of the invention and, together with the description, serve to explain the principles of the invention.

FIG. 1 is a perspective view of a building and chimney utilizing the invention;

FIG. 2 is a fragmentary sectional view of the chimney showing the invention attached thereto;

FIG. 5 is a perspective view of the cleaning element and catch assembly of the invention.

Figure 3:
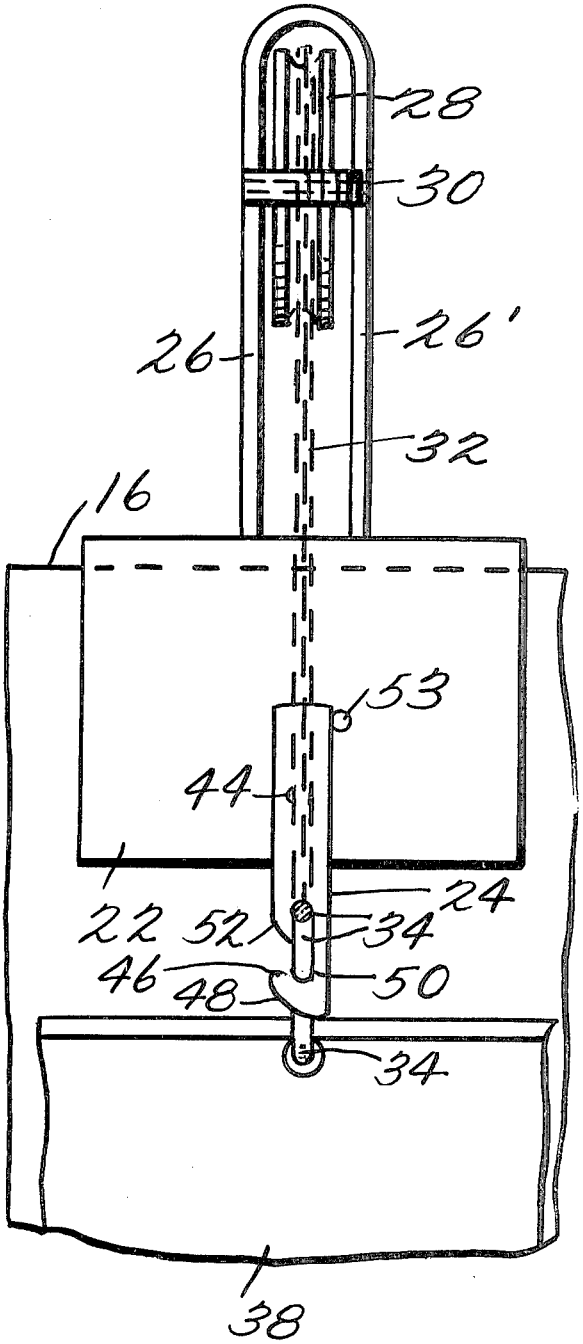
FIG. 3 is a fragmentary sectional view substantially along line 3—3 in FIG. 2 and looking in the direction of the arrows.

With reference now to the drawings wherein like reference characters designate like or corresponding parts throughout the several views, there is shown in FIG. 1 a house or other building 10 having a flue-lined chimney 12. Chimney cleaning apparatus 14 of the invention is shown in position on an upper edge 16 of the chimney or flue. The chimney cleaning apparatus of the invention is illustrated in more detail in FIGS. 2–5.

Apparatus 14 comprises a base member 18 having flange members 20, 22 depending therefrom to form a channel 23 for placement over upper edge 16 of flue 24. Substantially upright supports 26, 26′ depend upwardly from base member 18, and a pulley 28 is mounted in a conventional manner about axle pin 30, which extends between and is supported by upright supports 26, 26′. A rope or chain 32 extends over the top of pulley 28 with one end attached to horizontal bar 34 of cleaning element 38 located within the chimney. The other end of rope or chain 32 extends downwardly outside of the chimney to a location adjacent to ground level where it can be wrapped about retaining member 36 (FIG. 1). Horizontal bar 34 is attached to cleaning cylinder or element 38, which is adapted to remove soot and carbon buildups from the interior of the flue by moving upwardly and downwardly in contact with the flue walls.

In accordance with the invention, means 40 are provided in operative relationship with flange member 22 for holding cleaning element 38 in a fixed position within the chimney flue when the apparatus is not in use. More specifically, holding means 40 include an arm 42 rotatably attached to flange member 22 and defining a hook 46 at one end thereof for receiving and holding a portion of horizontal bar 34 when cleaning element 38 is in a fixed position and when the apparatus is not in use.

Bolt 44 is attached to flange member 22 so as to cause hook end 46 of holding arm 42 to normally be positioned below the other portions of the holding arm when the arm is in the normal, at-rest position. Hook 46 also defines an end camming surface 48 and a slot 50 having an inner camming surface 52. Each of camming surfaces 48 and 52 are preferably curved. A stop 53 is also attached to flange member 22 and adjacent the upper end of arm 42 for limiting rotational movement of the arm about bolt 44.

Cleaning element 38 is normally held in fixed position within the chimney when the apparatus is not in use. This is accomplished by means of hook 46 engaging holding arm 34 of cleaning element 38 (FIGS. 2 & 3). In order to clean the interior of the chimney flue, rope or chain 32 is removed from retaining member 36 by an operator standing at ground level. Loosening of the rope or chain and removal thereof from retaining member 36 will not cause cleaning element 38 to descend within the chimney. The cleaning element remains held in fixed position by means of hook 46. This is an important safety feature of the invention. Rope burns or other injuries to the operator are avoided. The cleaning element only descends within the chimney when the operator is prepared and after the operator has purposely initiated the descent by first pulling sharply down on the rope or chain.

Figure 4:
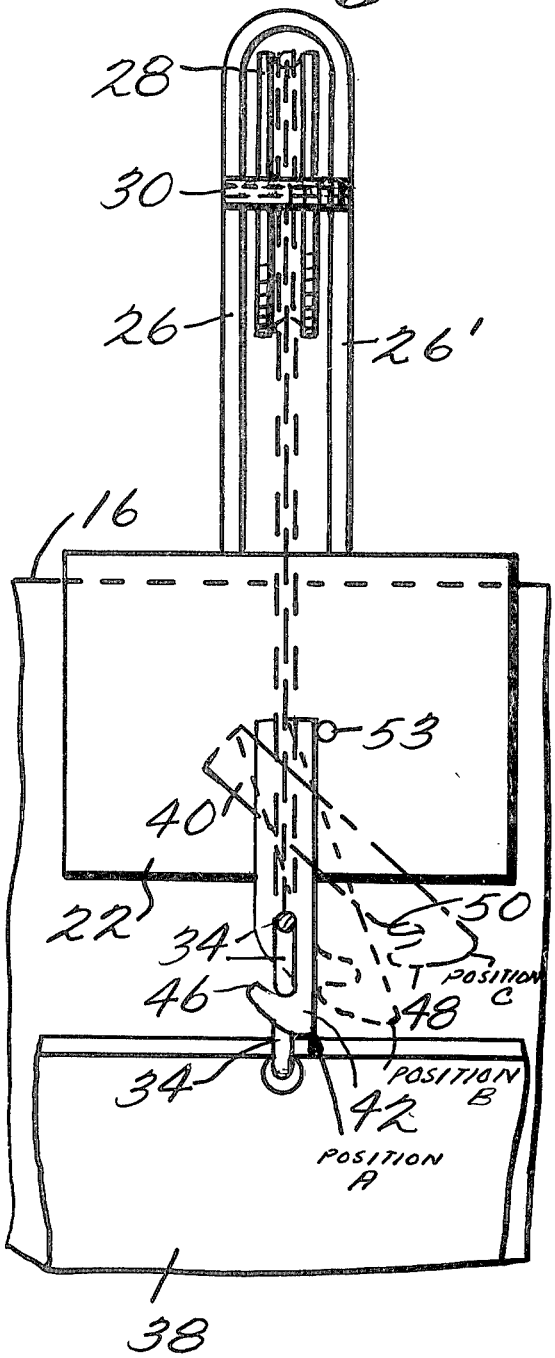
FIG. 4 is a fragmentary section substantially along line 4—4 in FIG. 2 and looking in the direction of the arrows but showing the catch assembly in different positions A, B and C of operation.

When the operator pulls sharply down on the rope or chain 32, horizontal bar 34 of cleaning element 38 sharply contacts camming surface 52 of hook 46. This causes holding arm 42 to be sharply pivoted about bolt 44 to position C (FIG. 4). The operator then creates slack in or releases rope or chain 32, and the weight of cleaning element 38 causes horizontal bar 34 to quickly descend past hook 46 before the hook returns to its normal position A. The operator can then cause cleaning element 38 to move downwardly and then upwardly within the chimney flue in a controlled manner to remove soot and carbon from within the flue.

After the cleaning process is completed, cleaning element 38 is raised slowly within the chimney by means of the operator pulling downwardly on rope or chain 32. Horizontal bar 34 contacts camming surface 48 of hook 46 to cause holding arm 42 to rotate slightly about bolt 44 to position B (FIG. 4). The operator continues to slowly raise cleaning element 38 to its upward limit, and the operator then slowly causes cleaning element 38 to be lowered by paying out rope or chain 32. In the meantime, holding arm 42 pivots about bolt 44 and back to its normal position A so that horizontal bar 34 is lowered into position onto hook 46. The cleaning element is then held in fixed position within the chimney and rope or chain 32 may be secured to retaining member 36 until the next use of the apparatus.

This invention provides for quickly and safely cleaning the interior of a chimney by an operator standing at ground level. The chimney cleaning apparatus enables the cleaning element to be quickly and easily locked into position within the chimney when the apparatus is not in use. The apparatus also enables the cleaning element to be quickly and safely unlocked from its fixed position for the purpose of cleaning the interior of the chimney. The invention provides a safety feature which prevents the cleaning element from becoming unlocked from its fixed position even if the rope or chain extending to the ground level becomes unfastened from retaining member 36. The cleaning element will be unlocked from its normal fixed storage position only if the operator first pulls sharply down on the rope or chain and then quickly allows the cleaning device to drop below hook 46. This safety feature reduces the possibility that children could accidentally cause the cleaning element to fall to the bottom of the chimney merely by loosening rope or chain 32 from retaining member 36 and the possibility of injury to children or to the operator is reduced.

The invention in its broader aspects is not limited to the specific details shown and described, and departures may be made from such details without departing from the principles of the invention and without sacrificing its chief advantages.

What is claimed is:

1. Chimney cleaning apparatus, comprising:
   - means for movement within the chimney for cleaning the interior of the chimney;
   - means in operative relationship with said cleaning means for moveably supporting said cleaning means inside the chimney; and
   - means in operative relationship with said supporting means for holding said cleaning means in a fixed position when said apparatus is not in use, said holding means including an arm moveably attached to said supporting means and defining a hook at one end thereof for receiving and holding a portion of said cleaning means when said cleaning means is in said fixed position, said holding arm being rotatably attached to said supporting means about an axis positioned to cause said hook end of said holding arm to normally be positioned below the other portions of said holding arm when said arm is in a normal, at-rest position, and wherein said hook defines an end camming surface and a slot having an inner camming surface.

2. Apparatus as in claim 1 wherein said end camming surface is normally positioned to slideably contact said portion of said cleaning means when said cleaning means is moved upwardly and into contact with said holding arm.

3. Apparatus as in claim 2 wherein said inner camming surface is normally positioned to slideably contact said portion of said cleaning means when said cleaning means is moved upwardly from said fixed position.

4. Apparatus as in claim 3 wherein said end camming surface and said inner camming surface are each curved.

5. Apparatus as in claim 4 further including means in operative relationship with said supporting means and with said holding arm for limiting movement of said holding arm about said axis.

6. Apparatus as in claim 5 wherein said supporting means include:
   - a removable support for positioning at the top of the chimney:
   - a pulley attached to said support for positioning over the interior of the chimney; and
   - a flexible line attached to said cleaning means and passing over said pulley to a location adjacent to ground level for enabling movement of said cleaning means within the chimney by movement of said flexible line by an operator from gound level.

7. Apparatus as in claim 6 wherein said cleaning means include:
   - an open-ended substantially cylindrical cleaning member shaped to substantially conform to the inside perimeter of said chimney; and
   - said portion of said cleaning means defining a bar connected to said cleaning member.

* * * * *